United States Patent [19]

Pfanstiehl

[11] 4,301,199

[45] Nov. 17, 1981

[54] PRECUT FRAMING

[76] Inventor: John G. Pfanstiehl, Rte. 87, Andover, Conn. 06232

[21] Appl. No.: 65,642

[22] Filed: Aug. 10, 1979

Related U.S. Application Data

[63] Continuation-in-part of Ser. No. 855,838, Nov. 30, 1977, abandoned.

[51] Int. Cl.[3] ..... A47G 1/08; G09F 1/12

[52] U.S. Cl. ..... 428/14; 40/158 R; 40/594; 428/40; 428/43; 428/192

[58] Field of Search ..... 428/14, 40, 78, 187, 428/189, 190–192, 343, 344, 43; 40/158 R, 159, 594

[56] References Cited

U.S. PATENT DOCUMENTS

| | | | |
|---|---|---|---|
| 2,358,831 | 9/1944 | Schieman | 428/351 |
| 2,805,485 | 9/1957 | Krummel | 428/192 X |
| 2,876,575 | 3/1959 | Leika | 156/279 X |
| 2,880,862 | 4/1959 | Sermattei | 428/40 |
| 3,143,208 | 8/1964 | Sizemore, Jr. | 428/43 |
| 3,467,250 | 9/1969 | D'Elia et al. | 428/906 X |
| 3,553,062 | 1/1971 | Berlin | 428/21 |
| 3,560,319 | 2/1971 | Kuhlman | 428/40 |
| 3,648,835 | 3/1972 | Yucel | 428/156 |
| 3,687,770 | 8/1972 | Chase | 156/221 |
| 3,752,304 | 8/1973 | Alef | 428/131 X |
| 3,761,344 | 9/1973 | Mrozek et al. | 428/41 |
| 3,794,554 | 2/1974 | Caring | 428/131 X |
| 3,886,677 | 6/1975 | Behring et al. | 428/14 X |
| 4,082,875 | 4/1978 | Citron | 428/14 X |
| 4,150,184 | 4/1979 | Tesch | 428/43 |

*Primary Examiner*—Henry F. Epstein
*Attorney, Agent, or Firm*—McCormick, Paulding & Huber

[57] ABSTRACT

Precut framing dimensioned and shaped to form a frame and support for pictures, posters and the like includes a strip of material with a decorative front surface and an adhesive coating on the back surface. The strip has a configuration resembling a trapezoid with precut mitered edges and dimensions suitable for standard size pictures. Two protective tearoff sheets extend longitudinally along the backside of the strip and prevent the adhesive coating from attaching the strip to objects prematurely. To apply the strips as a decorative frame and support for a picture, the tearoff sheets are removed at different steps in a sequence to facilitate alignment and positioning of the strip and the supported picture. The strips may be provided with visible marks to aid in the alignment of the strips on a picture and the elimination of additive errors as each mitered corner of the frame is formed.

21 Claims, 18 Drawing Figures

PRECUT FRAMING

CROSS REFERENCE TO RELATED APPLICATION

This application is a continuation-in-part of my copending application Ser. No. 855,838 filed Nov. 30, 1977 and now abandoned.

BACKGROUND OF THE INVENTION

The present invention relates to adhesive frames and, more particularly, to precut framing for assembling a decorative frame and support for a picture, poster or the like.

The typical method for attaching unframed pictures, posters and the like to a wall or other object is by pushing tacks through the picture into the wall, or by applying an adhesive tapeto the back surface or corners of the picture and pressing the tape against the wall. The use of tape to secure the back or corners of a picture, poster and the like to a wall is unsatisfactory in that the edges of the picture are free and the tape is not aesthetically pleasing in appearance. The tape does not contribute to the subject matter of the picture as a common frame does, and the supporting function of such tape is locally restricted and allows the edges of the picture to curl or be torn with further deterioration in appearance.

Sizemore, in U.S. Pat. No. 3,143,208 filed Sept. 16, 1960, discloses an adhesive tape having a series of longitudinal and transverse rows of perforations arranged in uniformly spaced, parallel relationship. A desired width or length of tape is obtained by tearing the tape about one or more rows. However the ends of this tape do not have a configuration suitable for forming a frame having miter joints around a picture.

Alef, in U.S. Pat. No. 3,752,304, filed Sept. 7, 1971, discloses a masking device comprising two triangular masks of sheet material for use in painting peripheries of rectangular surfaces. The masks having triangular shapes are intended to cover the entire surface of an object such as a window or the like except that portion of the object to be painted. In addition, the use of protective tear off strips as part of the construction of the mask is disclosed.

Caring, in U.S. Pat. No. 3,794,554 filed Jan. 19, 1972, discloses a sewing tape comprising a strip of thin flexible material having a plurality of longitudinally extending lines of perforations. The perforations are aligned to form both longitudinal and transverse lines. A suitable length of tape is cut off the roll using transverse lines in the tape. Accurate widths are obtained by pulling the tape apart along the lines of perforations. The tape includes adhesive material on one surface. This tape is also unsuited for framing pictures.

U.S. Pat. No. 3,886,677 issued to Behring discloses a framing tape made of flat strips of material, such as cardboard plastic and the like, which are subsequently cut and applied by means of adhesive backing to the edge of the picture for framing purposes. The strips, however, are handcut and can rarely be formed with precise mitered edges such as provided by a die cutter, and, as a result, an unsightly appearance is obtained at the mitered corners. Even when the tapes are accurately cut, precise positioning of the tape without further aids is difficult and an unsightly gap develops at one or more of the corners due to additive positioning errors. Also, the frame suggested by Behring can not serve as a support for the picture since the outer periphery of the frame is congruent with the periphery of the picture.

U.S. Pat. No. 4,082,857 issued to Citron discloses a border tape used to attach drafting paper and the like to drawing tables. Positioning indicia in the form of holes or transparencies in the tape allow the tape to overlie both the picture and the drawing board, but because the tape is only partially coated with adhesive on its back surface, positive attachment of the drafting material is not obtained.

It is a general object of the present invention to provide precut strips of framing material having accurately mitered edges and capable of being applied to the edges of a picture, poster or the like to form a supporting frame of aesthestically pleasing appearance.

SUMMARY OF THE INVENTION

The present invention resides in precut framing comprised by a decorative strip which when assembled with other strips forms a frame and support for a picture, poster and the like. The strip is an elongated strip of decorative material having a top edge and a bottom edge extending longitudinally of the strip, and a first precut side edge at one end of the strip. The side edge is cut at an angle to the top and bottom edges, such as 45°, to form the mitered corner of a frame when the side edge is placed in butting relationship with the side edge of another such precut strip. Similarly, the opposite end of the tape has a second precut side edge to form another mitered corner of the frame in conjunction with another strip of the decorative material.

The front surface of the strip has a decorative surface which is exposed when the strip is applied to a picture. The opposite, back surface has adhesive means for attaching one longitudinal portion of the strip in fixed position to a wall and another longitudinal portion to the picture.

Protective sheet means are releasably attached to the adhesive means to prevent the adhesion of the strip to other objects until the sheet means is removed. The sheet means includes a first tearoff sheet of a release material extending longitudinally along the strip and overlying the one longitudinal portion which attaches to the wall and a second tearoff sheet extending along the strip in adjacent relationship with the first tearoff sheet and overlying the other longitudinal portion of strip which attaches to the picture. In utilizing the strip to hang a picture, the one tearoff sheet is removed prior to the other tearoff sheet to permit the one longitudinal portion of the precut strip to be attached to the wall or a picture independently and without interference from the adhesive on the other longitudinal portion of the strip. Thereafter, the other tearoff sheet is removed for attachment of the picture or wall. The result is a properly positioned picture and strip.

In one embodiment, alignment means are provided along the mitered edges of the strip for proper registration of one strip relative to the other at the mitered edges. Gauge means may be included with the alignment marks to permit a strip to be placed in parallel relationship with the edge of a picture.

Additional pieces of the decorative material may be provided with the strip for the purpose of providing temporary positioning of the picture during framing or to form corner covers which overlie the mitered edges in the finished frame.

Fundamentally, the precut framing offers the advantages of more expensive frames, that is, they provide a decorative border for setting off a picture, and at the same time support the picture and protect the picture from damage along its edges. The decora tive character of a frame formed by the strips is preserved by the precut edges which may be assembed without additive errors and provide an aesthetically pleasing frame with well-formed corners.

DESCRIPTION OF PREFERRED EMBODIMENTS

Figure 1:
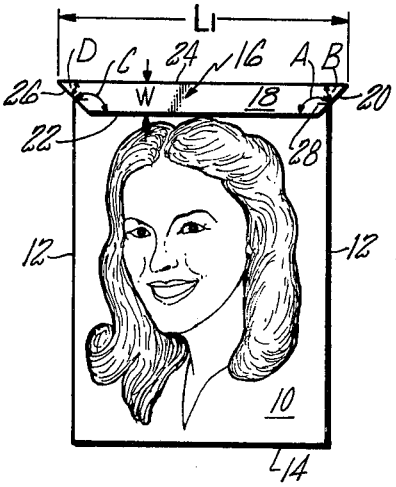
FIG. 1 shows a picture, poster or the like having one side supported and covered by precut framing in accordance with the present invention.

FIG. 1 illustrates one of the precut framing strips and its implementation as a decorative frame and support for a picture 10. Reference to a picture is intended to comprehend all such articles including posters and the like. The picture 10 has vertical sides 12 and horizontal sides 14 with the strip 16 of flexible framing material shown attached to the upper horizontal side 14. The strip is constructed of a suitable material such as paper, cloth, plastic, metal foil or the like. The front surface 18 of the strip is colored or may have a suitable design to set off the picture when framed. A first mitered side edge 20 at one longitudinal end of the strip forms the first interior angle A of 135° with a longitudinally extending bottom edge 22 of the strip, and a second interior angle B of 45° with the top edge 24. A second side edge 26 at the opposite longitudinal end of the strip forms a third interior angle C of 135° with the bottom edge 22 and a fourth interior angle D of 45° with the top edge 24.

Top edge 24 has a length L1 greater than the width of the picture and extends longitudinally of the strip in parallel relationship with the bottom edge. Together the side edges and the top and bottom edges define the perimeter of the framing strip 16 with a width W and the configuration of a trapezoid. The strip including the mitered side edges is accurately precut to size and shape by cutting dies or other high accuracy cutting machines.

The back surface of the strip opposite the decorative front surface has an adhesive coating (not shown) which may be a pressure-sensitive adhesive for attachment of the strip to a picture and a wall or other object.

Visible indicia or alignment marks 28 are located along the mitered side edges of the strip for properly locating one strip relative to another without additive errors in a sequential operation of laying the strips around a picture. The alignment marks are situated intermediate the top and bottom edges of the strip, preferably at a position along the mitered edge where standard size pictures would be expected to intersect the edge when the strip and the picture are properly positioned relative to one another. The marks permit sequential attachment of the strips to form a frame in overlying relationship with the edges of the picture, one longitudinal portion of each strip attaching to the wall and the other longitudinal portion attaching to the picture.

Figure 2:
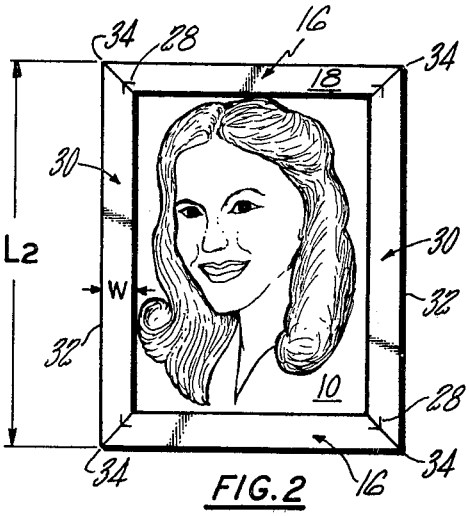
FIG. 2 illustrates the picture of FIG. 1 with a complete frame formed by four precut framing strips of the present invention.

FIG. 2 shows the picture with four of the precut strips of decorative material forming a frame along the edges of the picture. Each strip is comprised by a decorative material having attractive colors or patterns. The strips 30 extending along the vertical edges of the picture are similar to the strip 16, described in connection with FIG. 1 along the upper horizontal edge except that the longitudinal length L2 of the top or outer edge of the strip 30 is larger than length L1 of strip 16 to accommodate the larger vertical dimension of the picture. The strip 16 at the lower horizontal edge is the same as the strip at the upper edge. It will be noted that in spite of the greater length of the strips 30, the width W is the same as the strip 16. For pictures having square, hexagonal or other equal length sides, the lengths of the respective top and bottom sides of the strips will be equal. The formation of the frame and joining of the strips at the mitered corners 34 is described in greater detail below in connection with FIGS. 5–12 and 14–18.

The frame formed by the strips of material provides a pleasing contrast to a picture and serves a support for the picture as well. In this respect the present invention provides the same functions as a more conventional frame but without great expense and bulkiness. The strips of material may be more in keeping with the casualness of poster type pictures, but at the same time prevent the picture from wrinkling or curling and maintain a neat, flat and smooth appearance of the picture on a wall. Also, since the strips overlie the edge of the picture, there is less risk of tearing when the picture is brushed against or removed.

Figure 3:
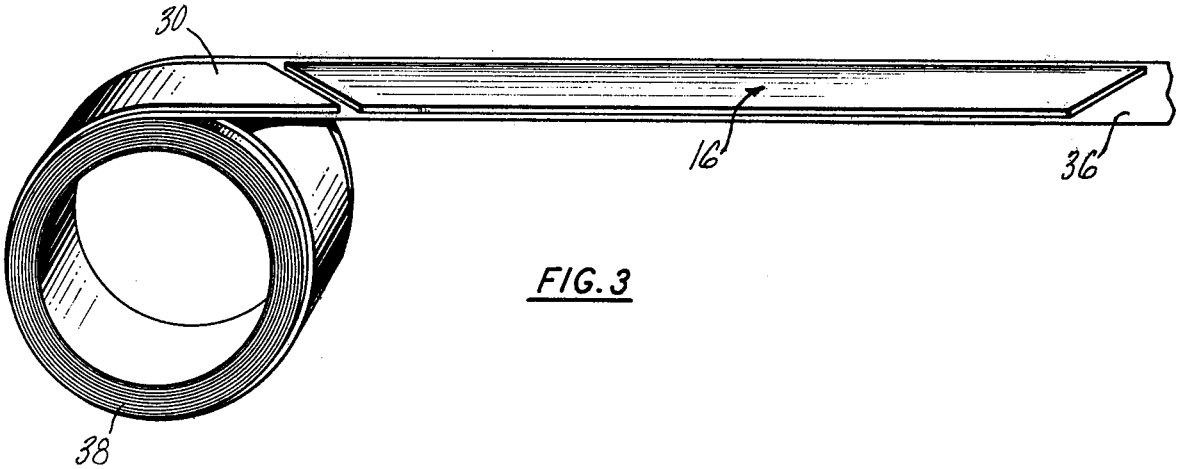
FIG. 3 shows a plurality of the precut framing strips rolled on a protective tearoff sheet of extended length.

FIG. 3 shows a plurality of the precut strips 16 and 30 attached to a protective tearoff sheet 36 having an extended length greater than the longitudinal length of the strips. The short strips 16 and the long strips 30 utilized in the frame of FIG. 2 are positioned sequentially along the strip which enhances the ability to supply all of the frame and materials in rolls. It should be understood, however, that each strip may be supplied individually with its own protective tearoff sheet or other accessories for use in hanging a picture.

Figure 4:
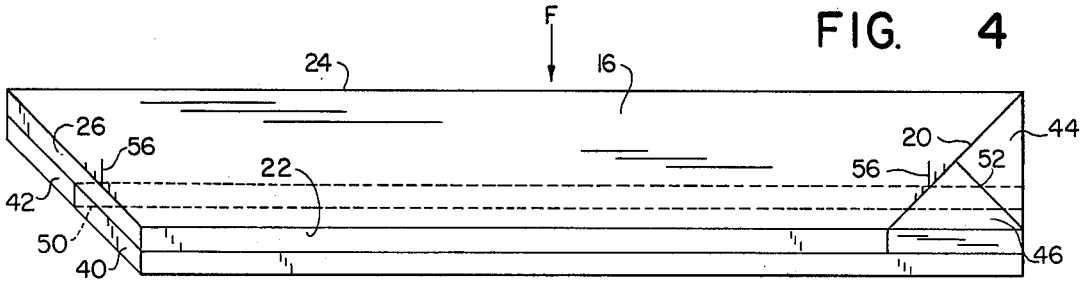
FIG. 4 is a perspective view showing one embodiment of the precut framing strip on a pair of protective tearoff sheets and includes a pair of assembly tabs formed from the same decorative material as the strip.

In accordance with the present invention, FIG. 4 illustrates my precut framing F which includes the strip 16 of decorative material described above, two tearoff sheets 40 and 42 releasable from the adhesive on the back surface of the strip 16, and a pair of assembly tabs 44 and 46 at one longitudinal end of the strip The tearoff sheets 40 and 42 of a waxed or coated release material extend longitudinally of the strip 16 and are separated by a longitudinal line of weakening 50 along the midsection of the strip 16. The thickness of the sheets 40 and 42 is greatly exaggerated in FIG. 4 so that the line of weakening more closely resembles a plane; however, the term "line of weakening" is intended to encompass slits between the tearoff sheets 40 and 42 formed by a die or other cutting tool, and other weakening devices which allow the strips to be removed individually from one longitudinal portion of the strip or the other.

The assembly tabs 44 and 46 are preferably constructed of the same decorative material as the strip 16, although other materials are possible. The exposed front surface of the tabs need not have a decorative appearance since the tabs, as explained in greater detail below, are merely used for temporary locaters or positioners. However, the back surface of the tabs like the strip 16 is entirely coated with a pressure-sensitive adhesive and hence, adheres to the tearoff strips 40 or 42. If the assembly tabs are made from the same material as the framing strip 16, the tabs are preferably separated from each other and from the mitered edge 20 of the strip 16 by lines of cut along the mitered edge 20 and the line of separation 52 between the tabs themselves. The lines of cut and separation extend only through the decorative material and not through the underlying tearoff sheets 40 and 42 so that the sheets hold the strips 16 and the assembly tabs 44 and 46 in a unitary package.

FIGS. 5–12 illustrate the manner in which precut framing comprised of flexible strips of decorative material with two longitudinally extending tearoff sheets on the back surface is utilized in assembling a frame for a picture 10.

Figure 6:
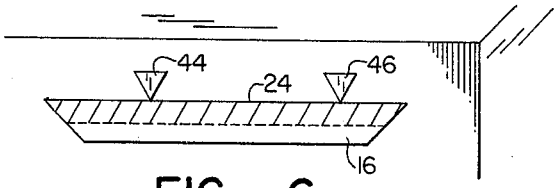
FIGS. 6–12 illustrate the sequence of steps by which a flexible precut framing strip with first and second tearoff sheets is utilized to form a frame and support for a picture.

Initially the assembly tabs 44 and 46 with a triangular or any other suitable form are removed from the sheets 40 and 42 and utilized to locate the top edge 24 of the strip 16. For example, as shown in FIG. 6, the apexes of the tabs may be located equal distances below a ceiling or other horizontal plane, and the strip 16 may be positioned against the tabs to establish a reference for the picture and other pieces forming the frame. The longer tearoff sheet 42 in FIG. 4 is then removed without disturbing the shorter tearoff sheet 40. The adhesive on the longitudinal portion of the strip 16 previously covered by the tearoff sheet 42 is now exposed and the exposed adhesive, illustrated by cross hatching, attaches the strip 16 to the wall with the top edge 24 in abuttment with the tabs 44 and 46. The strip is then properly secured as a reference for the rest of the frame and picture.

Figure 7:
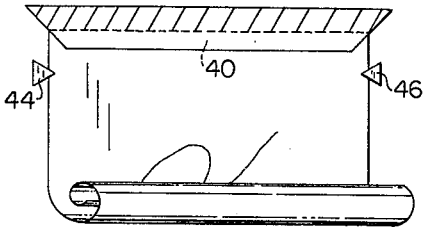

As shown in FIG. 7, the picture 10 is then inserted under the unsecured longitudinal portion of the strip 16 until the upper edge of the picture reaches the upper edge of the tearoff sheet 40 where the adhesive joins the strip to the wall. This edge of the tearoff sheet 40 corresponds to the line of weakening 50 and, is accurately established in parallel relationship with the strip edges 22 and 24, so that the insertion of the picture is automatically halted when the picture is in proper alignment with the parallel edges of the strip. Lateral centering of the picture 10 is then accomplished by means of parallelism gauges 56, one of which is detailed in FIG. 5, located along the mitered edges 20 and 26 at opposite ends of the strip. The gauge 56 is comprised by a series of graduations or lines intersecting the mitered edge with the central line being somewhat longer to serve the function of an alignment mark as described hereinafter. The central positioning of the strip may be held as illustrated in FIG. 7 by means of the assembly tabs 44 and 46 or by a similar set of tabs accompanying one of the other framing strips.

Figure 8:
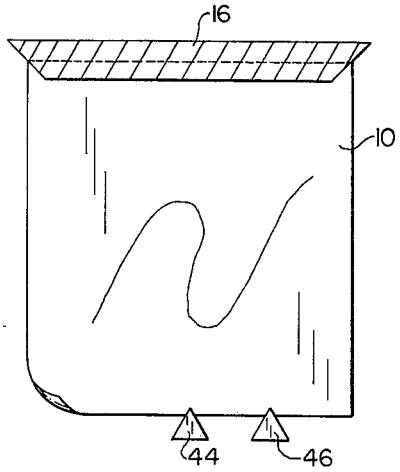
Figure 9:
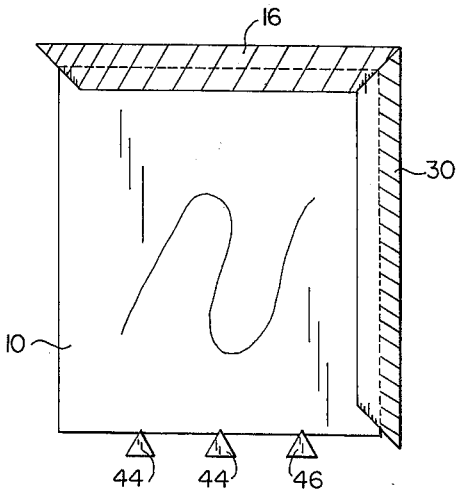

Once the picture has been inserted and centered relative to the strip 16, the tearoff sheet 40 is removed from the shorter longitudinal portion of the strip by lifting the inner edge of the strip and peeling the sheet away. The shorter longitudinal portion is then brought in adhesive contact with the upper edge of the picture. Pressure is firmly applied to the entire decorative surface of the strip to insure firm attachment of the strip to the wall and to the picture. The picture is now positionally fixed for attachment of the remaining strips of the frame, and to hold the picture in a flattened position, the assembly tabs 44 and 46 or other similar tabs are temporarily attached to the bottom edge of the picture and the wall as shown in FIGS. 8 and 9. The assembly tabs are particularly helpful in holding the picture flat and in place in situations where the picture has been stored or held for extended periods in a rolled-up form such as is common for most currently marked posters.

Figure 5:
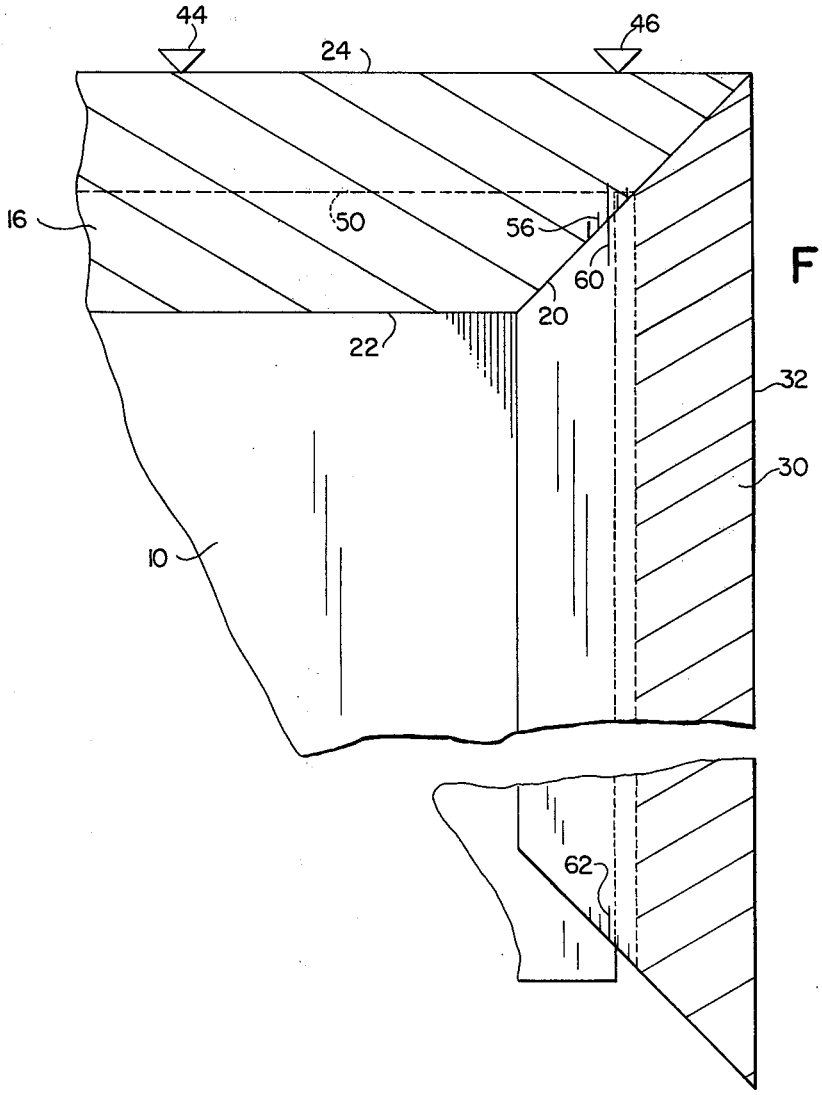
FIG. 5 is a fragmentary view of two framing strips in a partially assembled frame.

FIGS. 5 and 9 illustrate the placement of the second framing strip 30 in overlying relationship with the right-hand vertical edge of the picture 10. As shown in the details of FIG. 5, the upper end of the strip 30 has an alignment mark 60 which is located directly opposite the longest graduation of a parallelism gauge 56 (described above) to insure proper location of the strip 30 along the mitered edge 20 of the strip 16. In addition, another parallelism gauge 62 at the lower end of the strip 30 is provided to align the strip in parallel relationship with the vertical edge of the picture in conjunction with the upper gauge 56. By butting the mitered edges of the strips 16 and 30 against one another and utilizing the parallelism gauges 56 and 62 as a guide, proper registration of the strip 30 can be made with the picture 10 and the strip 16 without gaps or overlap at the mitered edges. It is this operation which requires the high accuracy of precut edges to prevent the accumulation of additive positioning errors and which is not obtainable by the ordinary individual in a manual cutting process.

Figure 10:
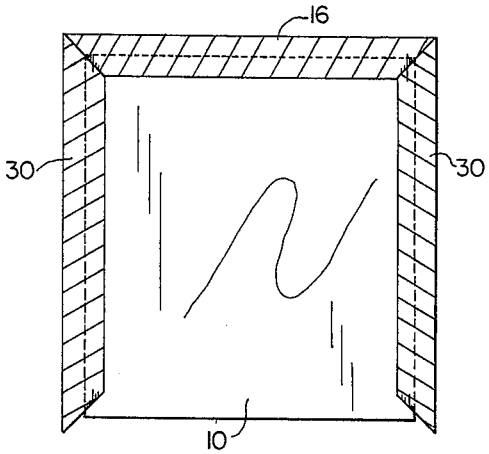
Figure 11:
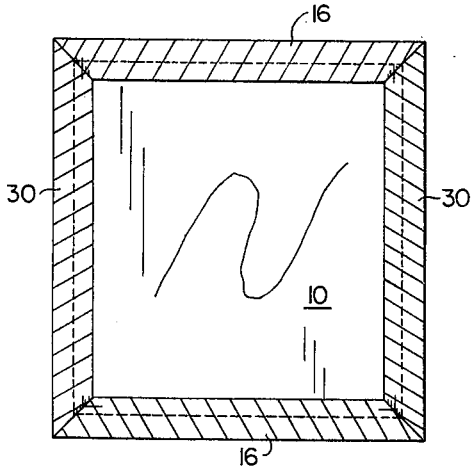

With the strip 30 properly located, the longer tearoff strip adjacent the outer edge 32 is removed without displacing the strip, and the strip is secured in position by pressing the then-exposed adhesive against the wall to establish firm attachment along the longitudinal shaded portion shown in FIGS. 5 and 9. Thereafter, the tearoff strip along the inner edge of the strip 30 is removed, and the remaining longitudinal portion of the strip is pressed against the edge portion of the picture 10. The process of attaching the strip 30 to the right-hand side of the picture 10 is repeated at the left-hand side of the picture with another strip 30 to form three sides of the frame as shown in FIG. 10. Thereafter the fourth side of the frame is completed with another strip 16 along the bottom edge of the picture by removing the outer tearoff strip after alignment marks on the abutting strips are brought in registration. Then the inner tearoff strip is removed and the strip is pressed firmly against the picture as shown in FIG. 11. Thus, the four framing strips are brought together in a single frame by accurately positioning each strip relative to one another and relative to the edges of the picture.

The parallelism gauges 56 and 62 are used for several functions. Initially the gauges allow the picture and top strip to be placed in centered relationship. At least one such gauge at the lower end of each side strip allows the side strips to be located in parallel relationship with the edge of a picture. And lastly, the gauges cooperate with the alignment marks to properly locate adjacent strips in registration at the mitered corners. For interchangability of the strips, it is desirable to include the gauges at each end of all strips forming the frame.

Figure 12:
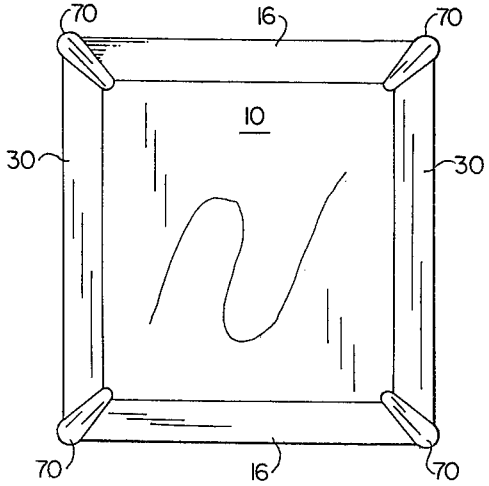

If desired, decorative corner covers may be applied over the mitered edges at butting ends of the framing strips as shown in FIG. 12. The corner covers may be comprised by the same decorative material as the framing strips 16 and 30, or a contrasting material, and include on the back surfaces, which rest against the framing strips, a pressure-sensitive adhesive for holding the covers in place. The dimensions of the covers 70 are preferably at least equal to the length of the mitered joint between the strips 16 and 30 so that no portion of the joint is exposed. The covers may have many desired shapes and designs which contribute to the aesthetically pleasing appearance of the frame. In addition to covering the mitered joints, the corner covers 70 also hide any gaps or overlaps that may exist between adjacent framing strips due to misplacement.

Figure 13:
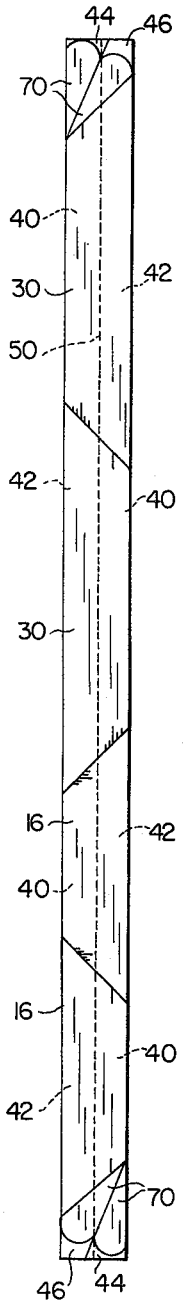
FIG. 13 illustrates a package in which the precut framing illustrated in FIGS. 6–12 is supplied.

FIG. 13 illustrates a package which contains all of the framing strips 16 and 30 as well as the assembly tabs 44 and 46 and the corner pieces 70 for the frame illustrated in FIG. 12. The framing strips 16 and 30 are arranged in end-to-end relationship and are secured by the adhesive to pairs of tearoff sheets 40 and 42 interconnected at the ends of each strip, preferably by lines of perforations. In this package the tearoff sheets are completely separated along one extended line of weakening 50 running longitudinally along the mid-section of the strips. The strips themselves, as well as the assembly tabs 44 and 46 and the corner covers 70, are preferably completely severed from each other by die cuts which extend through the decorative material to the lines of perforations in the tearoff sheets. Thus, the individual framing strips, such as the strip 16 may be separated from the extended package by tearing or separating the respective tearoff sheets along the perforations where the decorative sheet material has been cut. Also, it will be readily understood that the entire package can be economically prepared by attaching decorative material to releasable tearoff sheet material and cutting the decorative material with a die cutter in accordance with the dimensions and configurations of the strips, tabs and covers. The tearoff sheet material is also cut along the longitudinal line of weakening 50 but is only perforated at each division of the framing strips. It will also be noted that the assembly tabs 44 and 46, which are disposable, need not have a special configuration such as shown in FIG. 4 but may consist merely of portions of the decorative material which remain after the strips 16 and 30 and corner pieces 70 have been laid out.

FIGS. 14–18 illustrate a different method of assembling precut framing comprised by decorative strips 116 and 130 such as plastic and wood that are relatively rigid. Like the strips 16 and 30 described above, the rigid strips 116 and 130 are precut with mitered side edges and may be supplied in sizes which conform to standard size pictures. The front surface (visible only in FIG. 18) has a suitable decorative surface or finish and the back surface is coated with a pressure-sensitive adhesive over which two longitudinally extending tearoff sheets 140 and 142 are laid to prevent the adhesive from attaching to objects prior to assembly of the strips as a picture frame.

Figure 14:
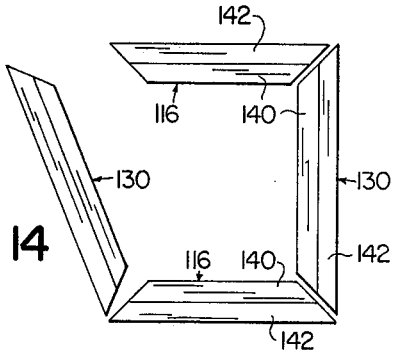
FIGS. 14–18 illustrate the manner in which a frame is assembled from precut framing that is relatively rigid.

To assemble the frame of rigid framing strips, the strips 116 and 130 are initially laid on a flat surface in the shape of the frame with the decorative, front surface face down and the tearoff sheets facing upward as shown in FIG. 14.

Figure 15:
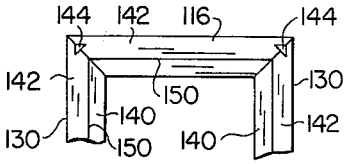

The precut, mitered side edges are butted tightly against one another and are aligned by means of alignment marks on the tearoff sheets or, preferably, the line of weakening 150 between the tearoff sheets is precisely cut between the top and bottom edges of the strip to serve as the visible alignment mark at each end of the strip. To hold the rigid framing strips in position, assembly tabs 144 provided with the strips are attached as shown in FIG. 15 to the corners of the frame and are positioned on the outer tearoff strips 142 without touching the inner tearoff strips 140.

Figure 16:
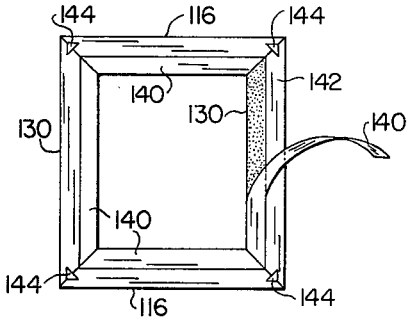
Figure 17:
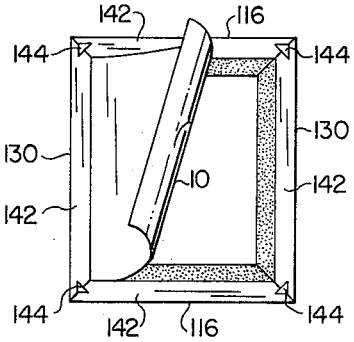

With the framing strips 116 and 130 secured by the assembly tabs 144 as shown in FIG. 16, the inner tearoff sheets 140 are removed from the longitudinal inner portion of each strip. As shown in FIG. 17, a picture 10 to be installed in the frame is positioned face down with edges overlying the now exposed adhesive on these longitudinal portions of the strips. Preferably the longest edge of the picture is first positioned on one of the longer side strips 130 and then the picture is smoothly flattened onto the horizontal strips 116 until the opposite side of the picture is attached to the remaining side strip 130. Pressure is applied along each edge of the picture to insure that the adhesive securely attaches the picture to the framing strips. After the picture is secured, the strips are fixed in their previously aligned, framing positions by the picture itself, and the assembly tabs 144 may be removed.

Figure 18:
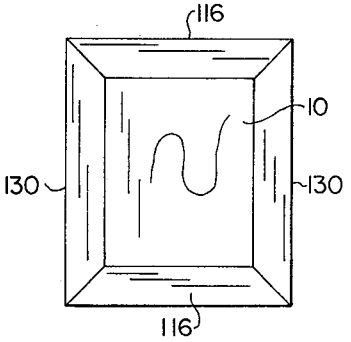

To hang the framed picture, the remaining tearoff sheets 142 are removed from the outer longitudinal portions of the framing strips along the periphery of the frame, and the frame with the picture facing outward is pressed against a wall or other object as shown in FIG. 18. To insure secure fastening, pressure is applied along the outer periphery of each strip. If desired corner covers such as shown in FIG. 12 may also be applied to the rigid framing strip.

Accordingly, the precut framing strips allow pictures to be framed and supported by means of decorative material with precisely cut miters that form a neat appearance in the finished frame.

Thus, precut strips of decorative material suitable for framing a picture and supporting the picture on a wall or other object have been disclosed. Each strip has adhesive means carried on its back surface for attaching one longitudinal portion of the strip to the wall and attaching another longitudinal portion to the picture. Tearoff sheets overlying the separate longitudinal portions of each strip aid in assembly of the frame and attachment of the frame and picture to a wall. The strips are precut with straight, scalloped and other shapes and with accurate mitered edges at each end to form an attractive frame about a picture and without generating additive errors that mar the frame appearance. The strips are also precut to exact length corresponding to standard size pictures and thus eliminate wasting large quantities of tape that might otherwise be purchased just for framing. Assembly tabs and corner covers may also be included with the strips as a package in either individual or roll form for convenient handling and storage. Accordingly, the present invention has been described in several embodiments by way of illustration rather than limitation.

I claim:

1. A precut framing for assembly as a decorative frame around a picture, poster, or the like and for attaching the picture to a wall or other support, comprising:

an elongated strip of decorative material having a top edge and bottom edge extending longitudinally of the strip, a first precut side edge angularly disposed to and connecting the top and bottom edges at one end of the strip, the first side edge being cut to form the mitered corner of a frame when the side edge is placed in abutting relationship with the side edge of another precut strip, a second precut side edge angularly disposed to and connecting the top and bottom edges at the end of the strip opposite the first side edge, the second side edge also being cut to form another mitered corner of the frame when the second side edge is placed in abutting relationship with the side edge of another precut strip, the strip having a decorative front surface which is exposed when the strip is applied in overlapping relationship to the edge of a picture and decoratively hides the edges and corners of the picture, and an opposite back surface, adhesive means carried on an outer longitudinal portion of the back surface for attaching the outer longitudinal portion of the strip in fixed position to a wall or other object, the adhesive means also being carried on an inner longitudinal portion for attaching the inner longitudinal portion of the strip to a picture, and protective sheet means releasably attached to the adhesive means on the inner and outer portions for preventing adhesion of the strip to other objects until the sheet means is removed and for independently controlling the adhesive attachment of the strip to the wall and to the picture, the protective sheet means including a first tearoff sheet extending longitudinally along the strip and overlying said outer longitudinal portion of the strip that attaches to a wall, and a second tearoff sheet also extending longitudinally along the strip in adjacent relationship with the first tearoff sheet and overlying said inner longitudinal portion of the strip that attaches to a picture whereby one tearoff sheet may be removed from the back surface of the precut strip before the other to permit the one longitudinal portion of the precut strip to be attached to a wall and the other portion to a picture independently to enable orderly attachment of each precut strip in a manner to produce proper positioning of each precut strip relative to the picture, and to both abutting precut strips, and to the wall.

2. A precut framing for assembly as a decorative frame as defined in claim 1 wherein the adhesive means covers the entire back surface of the elongated strip.

3. A precut framing as defined in claim 1 wherein the first and second tearoff sheets are separated from each other along the longitudinal midsection of the elongated strip of decorative material.

4. A precut framing as defined in claim 1 wherein the first and second sheets are separated by a longitudinal line of cut at the midsection of the strip.

5. A precut framing as defined in claim 1 further including visible means on the framing strip for aligning the side edges of abutting strips in correct positional relationship.

6. A precut framing as defined in claim 5 wherein the visible means comprises first visible indicia positioned on the precut strip along the first side edge intermediate the top and bottom edges and, second visible indicia positioned on the precut strip along the second side edge intermediate the top and bottom edges.

7. A precut framing as defined in claim 6 wherein the first and second idicia comprise alignment marks on the strip of decorative material.

8. A precut framing as defined in claim 1 further including gauge means on the framing strip for placing the strip along the edge of a picture in parallel relationship with the edge of the picture.

9. A precut framing as defined in claim 8 wherein the gauge means comprises a plurality of graduations distributed along at least one side edge of the strip so as to be visible in registration with the edge of the picture.

10. A precut framing as defined in claim 1 wherein the elongated strip of decorative material is a relatively rigid material.

11. A precut framing as defined in claim 1 wherein the elongated strip of decorative material is comprised by a flexible material.

12. A precut framing for forming a decorative frame as defined in claim 1 wherein:

the protective sheet means is larger than the strip of decorative material; and additional pieces of material having adhesive surfaces are positioned on the protective sheet means.

13. A precut framing for forming a decorative frame as in claim 12 wherein the additional pieces of material comprise assembly tabs for holding a picture in place as the strip of decorative material is applied.

14. A precut framing as defined in claim 12 wherein the additional pieces comprise corner covers for overlying the mitered side edges in the assembled frame, and are also made of a decorative material.

15. A precut framing as defined in claim 1 wherein the first and second sheets are separated by a line of weakening extending longitudinally of the strip for individual removal of the sheets.

16. A precut framing for forming a decorative frame and support for a picture, poster or the like comprising:

an elongated strip of frame material having a decorative front surface and an adhesive back surface, the elongated strip having longitudinal edges extending along opposite sides of the strip and precut mitered edges at each end of the strip, the one longitudinal edge being longer than the opposite longitudinal edge and the edge of the picture to be supported by the strip;

strippable tearoff means overlying the adhesive surface of the elongated strip to protect the strip from adhering to objects prematurely, and including an elongated sheet of releasable material having dimensions greater than the dimensions of the strip of decorative material; and additional pieces of the frame material having the decorative front and adhesive back surfaces attached to the strippable tearoff means adjacent a mitered edge and separated from the mitered edge by a line cut through the decorative material to the sheet of releasable material at the back surface, the additional pieces including a plurality of the elongated strips in end-to-end relationship on the elongated sheet of releasable material, each of the strips having precut mitered edges defined by the lines cut through the decorative material to the releasable material, the pieces being dimensioned and mitered to form a frame and support overlying the edges of a picture.

17. A precut framing as defined in claim 16 wherein the additional pieces comprise assembly tabs to serve as temporary restraints during assembly of the frame pieces and picture.

18. A precut framing as defined in claim 16 wherein the additional pieces comprise corner covers dimensioned to overlie the mitered edge of the elongated strip in the assembled frame.

19. A precut framing as defined in claim 16 further including in the additional pieces both corner covers and assembly tabs made from the decorative material and separated by line cuts through the material to the sheet of releasable material at the adhesive back surfaces.

20. A precut framing as defined in claim 16 wherein the elongated sheet of releasable material is partially cut through the releasable material along lines corresponding to the line cuts through the decorative material.

21. A precut framing as defined in claim 16 wherein the elongated sheet of releasable material is cut into two portions along a line of weakening extending longitudinally of the sheet.

* * * * *